US007108439B2

(12) United States Patent
Zhu

(10) Patent No.: US 7,108,439 B2
(45) Date of Patent: Sep. 19, 2006

(54) FLEXIBLE BARREL WRITING INSTRUMENT

(75) Inventor: Gaoyuan Zhu, Ningbo (CN)

(73) Assignee: Raymond Geddes & Company, Inc., Baltimore, MD (US)

( * ) Notice: Subject to any disclaimer, the term of this patent is extended or adjusted under 35 U.S.C. 154(b) by 455 days.

(21) Appl. No.: 10/420,145

(22) Filed: Apr. 22, 2003

(65) Prior Publication Data

US 2005/0201810 A1 Sep. 15, 2005

(51) Int. Cl.
*A46B 5/02* (2006.01)
*B43K 5/16* (2006.01)

(52) U.S. Cl. ..... 401/6; 401/109

(58) Field of Classification Search ..... 401/6, 401/52, 195, 209, 99, 109–111
See application file for complete search history.

(56) References Cited

U.S. PATENT DOCUMENTS 1,586,522 A * 6/1926 Deli ..... 401/76
1,950,960 A * 3/1934 Wisser ..... 33/27.02
2,266,942 A * 12/1941 Wallace ..... 63/1.12
2,488,179 A * 11/1949 Engel, Jr. ..... 401/54
2,911,950 A * 11/1959 Freeman ..... 401/209
3,419,336 A * 12/1968 Kirk ..... 401/111
3,994,605 A * 11/1976 McKnight ..... 401/99
4,162,754 A * 7/1979 Fleming ..... 224/165
4,227,823 A * 10/1980 Kitzerow ..... 401/99
4,580,919 A * 4/1986 Ambasz ..... 401/117
4,601,598 A * 7/1986 Schwartz et al. ..... 401/6
4,906,119 A * 3/1990 Hartford et al. ..... 401/6
5,354,140 A * 10/1994 Diakoulas ..... 401/6
5,584,195 A * 12/1996 Liu ..... 63/1.12

* cited by examiner

*Primary Examiner*—David J. Walczak
(74) *Attorney, Agent, or Firm*—Sterne, Kessler, Goldstein & Fox P.L.L.C.

(57) ABSTRACT

A writing instrument having a retractable ball point pen with a metallic coil or spring barrel which permits the instrument to bend, a cushion or textured grip, inner and upper sleeves to provide a housing for the ends of the ink refill cartridge, a click mechanism to extend and retract the ball point and a clip and method of producing the instrument.

17 Claims, 3 Drawing Sheets

ALL DIMENSIONS ARE IN CENTIMETERS

FLEXIBLE BARREL WRITING INSTRUMENT

FIELD OF THE INVENTION

The present invention is a writing instrument with a flexible barrel in the form of a spring. More particularly, the present invention is related to a writing instrument that is comprised of a coil or a spring mid section making up the body of the instrument. The spring means provides flexibility to the instrument barrel, making breakage unlikely. In addition, a metal spring barrel provides pleasantly textured grip and a novel appearance to the instrument. The metal spring can also be produced in a variety of colors or finishes including brass, chrome, silver plate, copper and the like. The instrument can also be fashioned with a rubber or textured grip below the spring. A method of making the instrument is also described.

BACKGROUND OF THE INVENTION

Currently pens and other writing instruments generally have a rigid barrel through which the writing mechanism, lead or ink cartridge passes. Such rigidity frequently leads to breakage as writing instruments are frequently carried in garment pockets, briefcases, purses and the like. In general, writing instruments such as gel ink pens and conventional ball point pens contain liquid ink, which is subject to release upon instrument breakage resulting in terrible ink stains.

Some writing instruments in sale may have flexible barrels; however, in order to maintain flexibility, the instruments offer a limited supply ink cartridge, a distinct disadvantage. Certain instruments on the market have bendable barrels made of soft plastic; however, the ink cartridge is restricted within the lower rigid part and may not be more than two inches long. The present invention overcomes such limitations of the available writing instruments, which are generally made of a rigid metal, plastic or other material, offering a novel design and approach to alleviating problems generally associated with writing instruments sold on the market.

Accordingly, there is a need for a writing instrument which has a flexible shaft but contains a standard size ink cartridge which is generally 4 inches or longer. There is an additional need to provide a writing instrument that can be produced in a variety of metallic finishes and colors. Further, there is a need to provide a writing instrument with a novel design, that is inexpensive and easy to produce.

SUMMARY OF THE INVENTION

Accordingly, it is an advantage of the present invention to meet these and other needs through preparing an instrument that contains a metallic spring or coil barrel.

It is another object of the invention to provide a writing instrument that maintains a flexible shaft.

It is still another object of the invention to provide a writing instrument that may be manufactured in a variety of different colors and metallic finishes.

Another advantage of the invention is that it contains a full sized ink cartridge at least 4 inch or longer.

It is another object of the invention to apply the coil or spring body to a marker or highlighter.

It is still another object of the invention to provide a writing instrument that is pleasant and comfortable to hold.

Another object of the invention is to provide a writing instrument comprising a metallic spring body, with a comfortable rubber or textured grip near the writing point.

It is yet another object of the invention to provide a writing instrument which is simple in construction, low in cost and easy to manufacture.

To achieve the stated and other advantages of the present invention, as embodied and described herein, the invention includes a writing instrument comprising a metallic spring or coil barrel, a rubber or textured grip, and a full size ink cartridge.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

Reference will now be made in detail to embodiments of the present invention, examples of which are illustrated in the accompanying drawings.

DETAILED DESCRIPTION OF THE INVENTION

Figure 1:
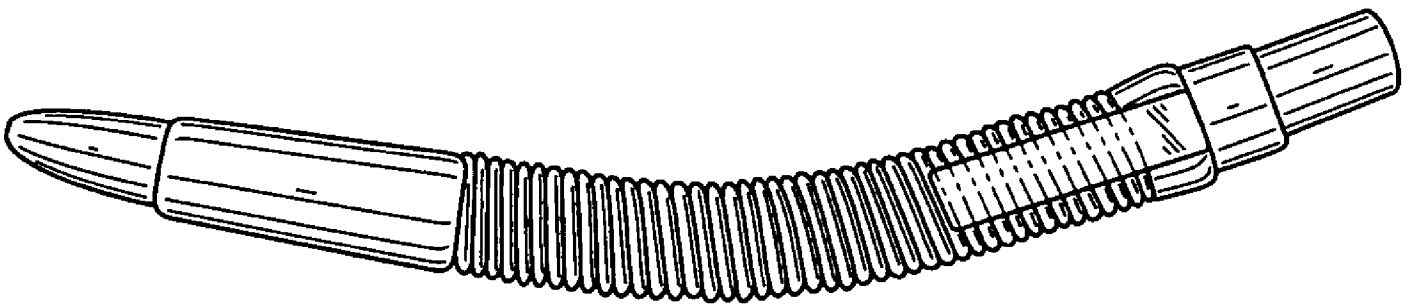
FIG. 1 illustrates the flexible barrel, shape and overall configuration of the invention.
Figure 2:
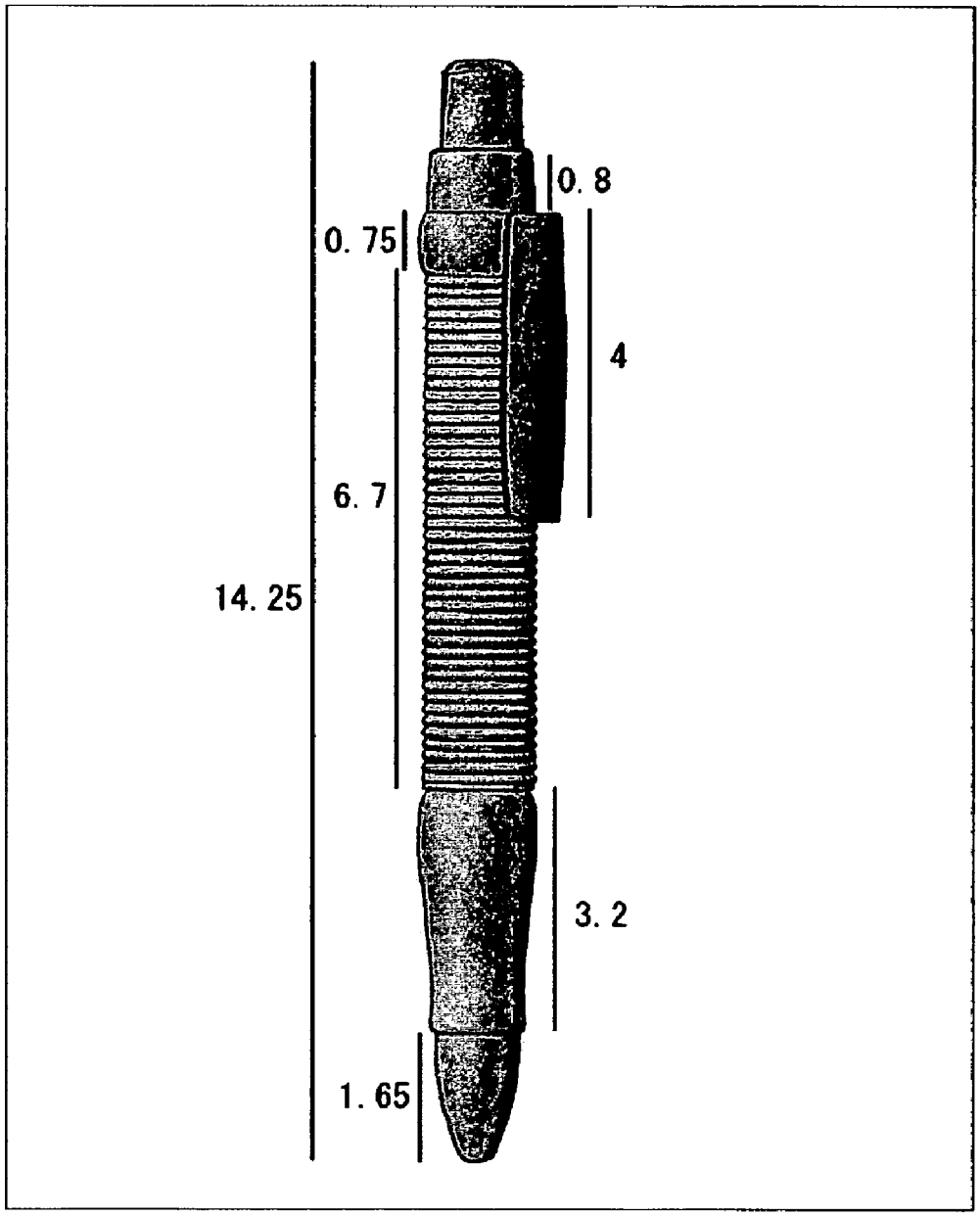
FIG. 2 provides the overall dimensions of the invention in centimeters.
Figure 3:
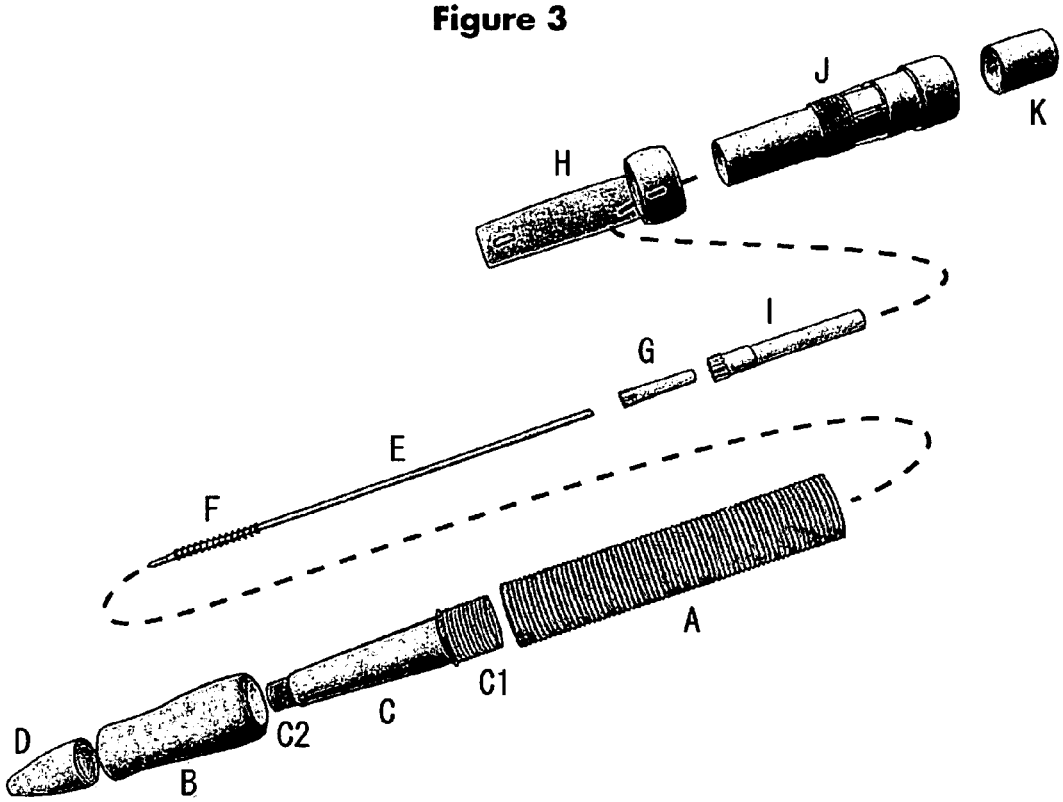
FIG. 3 identifies the component parts of the invention and illustrates the assembly thereof, viz., the structure of the instrument is comprised of a coil or spring barrel (A), a lower sleeve (C) with threads on either end (C1 and C2), a rubberized or textured grip (B), a point housing (D), a refill extension mechanism seat (J) and a clip (H). Internal to the invention is a flexible refill cartridge (E), a spring (F), an upper sleeve (G) and an extension mechanism (I).

The invention includes a writing instrument which is configured with a coil or spring for the body of the instrument. It is to be noted that any or all dimensions shown in FIG. 2 could be varied or changed as needed, the dimensions shown being only an illustration of an embodiment of the invention. This spring (A) is about 6.7 cm in length (see FIG. 2), but may vary in length from 2 cm to 8 cm. The spring is thick enough in diameter to provide a rigid but flexible barrel. Referring to FIG. 2, the inner diameter of the spring (A) is threaded which provides the mechanism for a union with a lower sleeve (C) oriented toward the point of the instrument. The sleeve provides inner support for the grip area of the instrument (B) and proceeds in decreasing diameter toward the instrument point. A soft, textured or rubberized grip (B) fits along the exterior of the sleeve. The sleeve is threaded on both ends (C1 and C2). The larger end of the sleeve is inserted into the coil and the smaller end of the sleeve is inserted into the point housing (D). The threads on the sleeve (C1) extend approximately 1 cm into the coil so as not to impede the inherent flexibility of the coil.

The point housing contains a spring (F) which encourages the refill ball point to remain in a retracted position by asserting upward pressure toward the top of the pen. Housed within the lower sleeve is the ink refill cartridge (E). The cartridge fits freely within the lower sleeve and extends into the body of the coil. The cartridge is made of flexible plastics such that the refill will give way when the coil barrel (A) is bent.

The refill (E) extends into an upper sleeve (G) located at the opposite end of the instrument from the writing point. This sleeve provides support along the clip of the instrument and extends about 3 cm into the coil. The upper sleeve (G) is connected to the refill extension mechanism (I) which permits the ball point nib to be extended during writing. The refill extension mechanism resides within a hollow seat (J) to which the clip (H) is attached. The seat (J) is threaded and secures to the coil (A). The refill extension mechanism passes through the seat and is exposed to permit the user to extend and retract the ball point nib. The presence of the coil barrel provides flexibility to the barrel as well as a pleasing texture to user.

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art. The materials, methods and examples are only exemplary and not limiting.

Preferred is a retractable ball point pen with a metallic coil or spring barrel body which permits the instrument to bend or be flexible, a cushion or textured grip, inner and upper sleeves to provide a housing for the ends of a full sized ink refill cartridge, a click-type extension mechanism to extend and retract the ball point, and a clip.

A method of making a writing instrument comprises the following essential steps:

1. Forming the mold for an injection mold for the plastic parts, namely the lower sleeve (C), the rubberized or textured grip (B), the point housing (D), the refill extension mechanism seat (J), the clip (H), the upper sleeve (G) and an extension mechanism (I).

2. Electroplating the point housing and refill extension seat.

3. Bending steel to create the coil barrel.

4. Hand-assembling or fitting together all parts to obtain a desired writing instrument.

Of course, having learnt the teachings of the present invention, one skilled in the art may vary the manufacturing process in different ways to meet the objectives of the present invention.

Example embodiments of the present invention have now been described in accordance with the above advantages. It will be appreciated that these examples are merely illustrative of the invention and not limitations thereof. Many variations and modifications will be apparent to those skilled in the art and all such modifications and variations are included within the purview and scope of the appended claims.

The invention claimed is:

1. A writing instrument, comprising:

a barrel made of a flexible coil spring allowing the barrel to bend, said barrel defining an outer exposed surface of the writing instrument;

a retractable writing point;

an ink cartridge connected to the retractable writing point;

a point housing; and an extension mechanism connected to the writing point, wherein the extension mechanism is configured to selectively position the writing point between an extended position outside the point housing and a retracted position within the point housing.

2. The instrument of claim 1, wherein the flexible coil spring is thick enough in diameter to provide a rigid but flexible barrel.

3. The instrument of claim 1, wherein the instrument is a pen.

4. The instrument of claim 1, further comprising a soft, rubberized or textured grip disposed along an exterior of the instrument to be gripped by a user.

5. The instrument of claim 1, further comprising a lower sleeve connected to a lower end of the flexible coil spring, wherein the extension mechanism is connected to an upper end of the flexible coil spring.

6. The instrument of claim 5, wherein the extension mechanism is housed in an extension mechanism seat, the extension mechanism seat being threadingly connected to the upper end of the flexible coil spring.

7. The instrument of claim 6, wherein a clip is attached to the extension mechanism seat.

8. The instrument of claim 5, wherein the lower sleeve decreases in diameter toward the writing point, wherein the smaller diameter end of the sleeve is connected to the point housing.

9. The instrument of claim 5, further comprising a soft, rubberized or textured grip disposed along an exterior of the lower sleeve.

10. The instrument of claim 1, wherein the ink cartridge is a flexible ink cartridge housed within the coil spring without impeding the flexible nature of the coil spring.

11. The instrument of claim 10, further comprising an upper sleeve, wherein the upper sleeve provides a housing for the upper end of the flexible ink cartridge.

12. The instrument of claim 10, wherein the point housing contains a spring which surrounds a lower end of the flexible ink cartridge so as to bias the writing point in the retracted position within the point housing.

13. The instrument of claim 1, wherein the ink cartridge is at least four inches long.

14. The instrument of claim 1, wherein the extension mechanism is a click-type extension mechanism.

15. The instrument of claim 1, wherein the coil spring is in the form of a cylinder.

16. A writing instrument, comprising:

a coil spring barrel body, wherein the coil spring barrel body is flexible thereby allowing the barrel body to bend, said barrel body defining an outer exposed surface of the writing instrument;

a cushion or textured grip which is to be gripped by a user during writing;

an ink refill cartridge extending the length of the barrel body and having a ball point nib;

lower and upper sleeves which house ends of the ink refill cartridge; and a click-type extension mechanism configured to extend and retract the ball point nib.

17. The instrument of claim 16, wherein the coil spring barrel body is in the form of a cylinder.

* * * * *